US006139512A

United States Patent [19]

Ricchio

[11] Patent Number: 6,139,512

[45] Date of Patent: Oct. 31, 2000

[54] METHOD AND APPARATUS FOR WATER THERAPY

[76] Inventor: Dominic A. Ricchio, P.O. Box 085777, Racine, Wis. 53408-5777

[21] Appl. No.: 08/888,720

[22] Filed: Jul. 7, 1997

Related U.S. Application Data

[60] Provisional application No. 60/016,096, Jul. 8, 1996.

[51] Int. Cl.[7] ..... A61H 23/00; A61H 33/02; A47C 17/00

[52] U.S. Cl. ..... 601/55; 601/61; 601/148; 4/541.4; 5/670; 5/689

[58] Field of Search ..... 601/55, 61, 148–150, 601/156, 158; 5/670, 689; 4/541.5, 541.4

[56] References Cited

U.S. PATENT DOCUMENTS

| | | | |
|---|---|---|---|
| 4,713,853 | 12/1987 | Ricchio | 5/451 |
| 4,785,484 | 11/1988 | Sargent | 4/542 |
| 4,858,255 | 8/1989 | Haisman | 4/544 |

*Primary Examiner*—Danton D. DeMille
*Attorney, Agent, or Firm*—Paul R. Puerner

[57] ABSTRACT

An apparatus and method of improved water therapy in which a person is buoyantly supported in a reclining or prone position on a top membrane of a enclosure which contains heated water, and air. A water pump recirculates the water which is drawn out of the enclosure through outlets and associated piping and which is then reintroduced into the interior of the enclosure through venturi air intake as waterjets that are mixed with air. The air enriched waterjets drive through a layer of water and impinge on the underside of the top membrane to produce massage effects on the person. The air is captured inside the enclosure in a chamber or pocket which rises above the water level within the sealed enclosure and is drawn out of the interior enclosure to the air inlet waterjet venturi for recirculation of air throughout and within the sealed enclosure. To supercharge the venturi inlet waterjet system, with forced air, a separate air pump and control valve can be connected to venturi waterjet means manifold to introduce and control the amount of pressurized air entering the venturi inlet waterjet means to enhance the velocity of the air enriched waterjet system which is a separate mode of operation, from recirculating the venturi air waterjet from within the sealed enclosure through venturi means.

9 Claims, 10 Drawing Sheets

METHOD AND APPARATUS FOR WATER THERAPY

CROSS-REFERENCE TO RELATED APPLICATIONS

This application claims the benefit of U.S. Provisional Application No. 60/016,096 filed Jul. 8, 1996, now abandoned.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

This invention relates to massage beds of the type having a water containing enclosure for buoyantly supporting a person in a reclining position wherein the person receives a dry massage while being supported on the massage bed.

2. Description of the Prior Art

The water massage bed of this invention is an improvement of the water massage beds shown in U.S. Pat. Nos. 4,635,620 and 4,713,853. The water massage bed of the present invention performs a more pleasurable and a more medically effective massage. In addition, the massage bed of this invention includes a comprehensive control system whereby the massage effects produced can be controlled so as to apply such effects to selected areas of the person.

BRIEF SUMMARY OF THE INVENTION

A water therapy massage apparatus including an enclosure having a top membrane of water impervious material for buoyantly supporting a person in a reclining position. The enclosure contains a volume of water and is supported by a base means. A plurality of water/air assembly inlets and at least one water outlet are sealingly mounted in the enclosure with the water/air assembly inlets spaced apart from each other and aimed upwardly toward the underside of the top membrane. Each water/air assembly has a water inlet, an air inlet and a venturi built into the assembly. A water pump is provided in fluid communication with the water outlet in the enclosure to draw water from the enclosure. The water pump is also in fluid communication with the water inlet of each water/air assembly. The water flowing through the venturi in the water/air inlet assembly will draw air into the assembly which becomes mixed with the water passing through the assembly. The water pump imparts sufficient pressure to the streams of the pressurized water/air mixture to drive the streams through the depth of water in the enclosure so that they will impinge on the underside of the top membrane and thereby produce massage effects to the person.

BRIEF DESCRIPTION OF THE SEVERAL VIEWS OF THE INVENTION

DETAILED DESCRIPTION OF THE INVENTION

Figure 3:
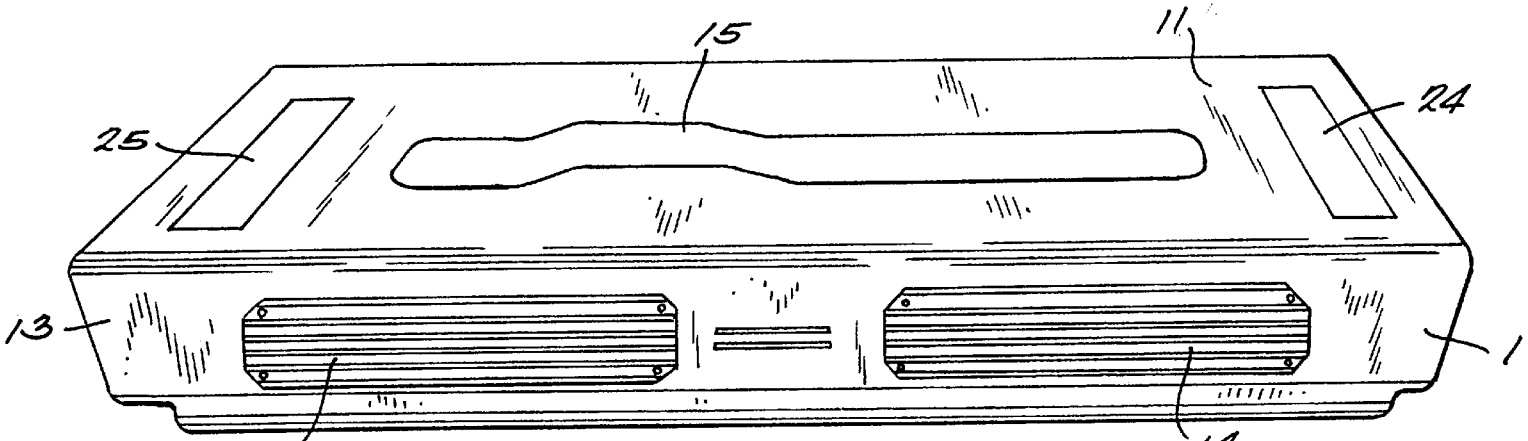
FIG. 3 is a perspective view of the pedestal support for the massage bed.
Figure 7:
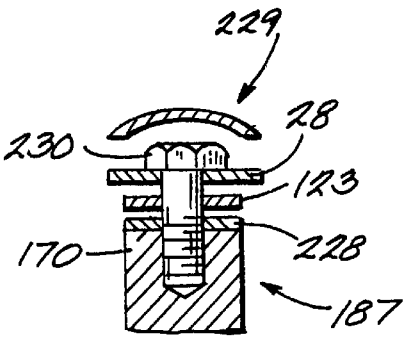
FIG. 7 is a exploded view of the top membrane seal assembly.
Figure 6:
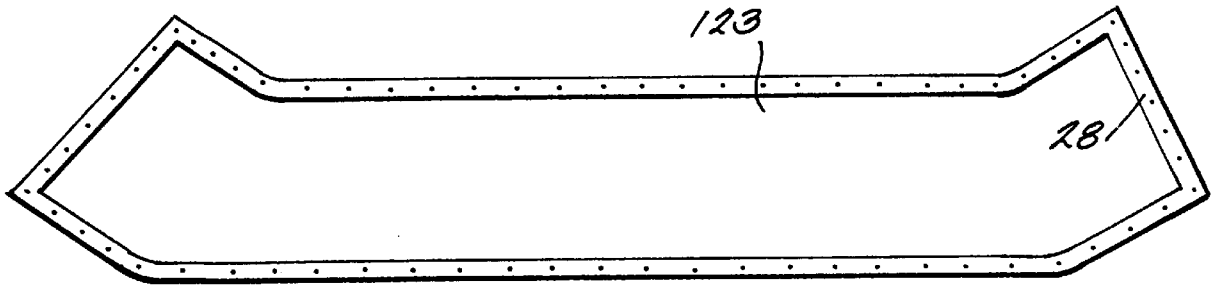
FIG. 6 is a perspective view of the top membrane member.

Description of the Pedestal Support Means As Seen in FIG. 3

Figures 1, 15:
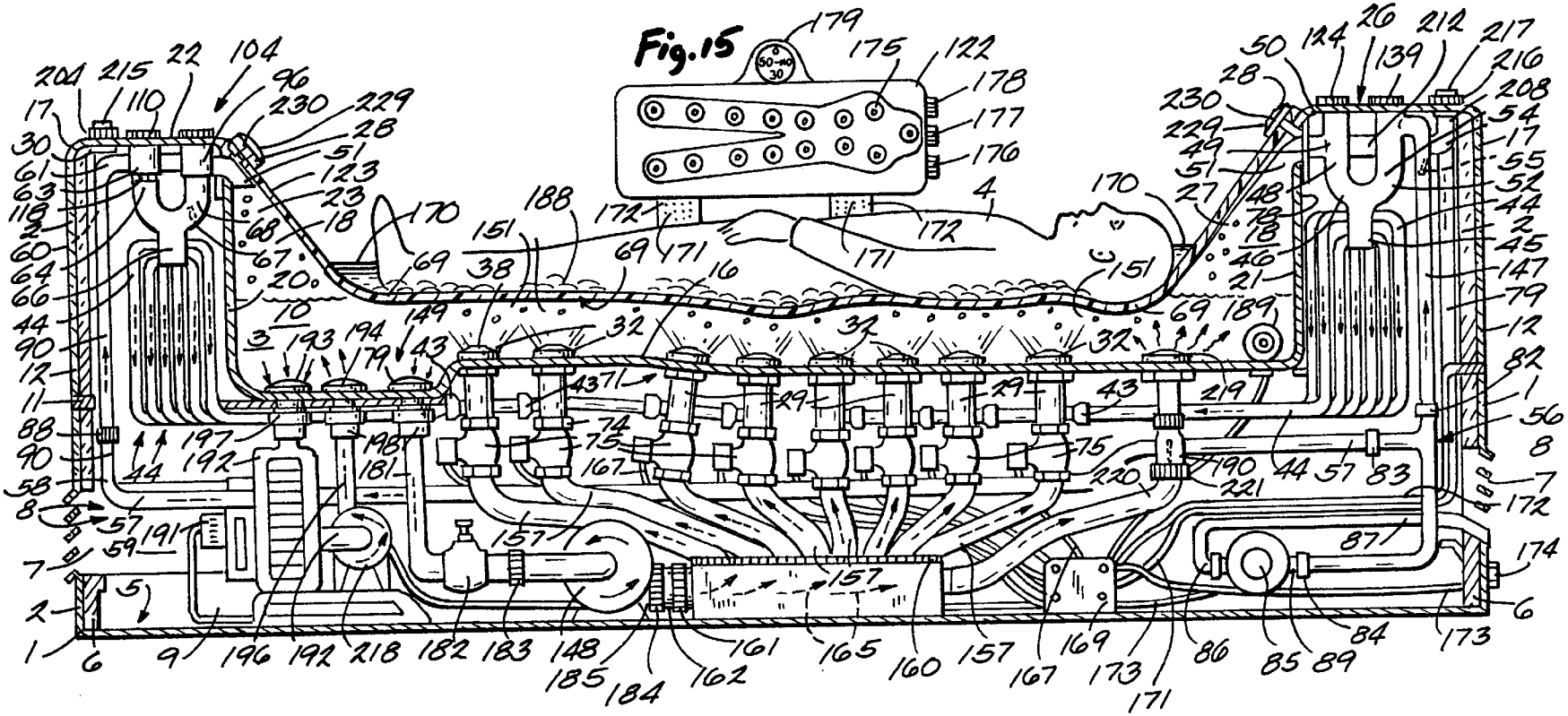
FIG. 1 is a partial schematic side elevation view of the massage bed of the present invention (split in two on two sheets for clarification)
FIG. 15 is a partially schematic side elevation view showing the control board for controlling the operation of the massage bed.

The acrylic formed pedestal support base 1 is reinforced with bonded fiber glass and resin 2 to its underside to add thickness to provide strength to its structure. The purpose of the pedestal support base 1 is to support the water, and air enclosure means 12 and all component parts as seen in FIG. 1 including the water 3 and the supported person 4. The pedestal base 1 construction includes a floor 5 connected to upwardly directed sidewalls not shown in FIG. 1. See FIGS. 3–13, and upwardly directed end sidewalls 6 air vents 7 provides cooling by recirculation of ambient air 8 throughout the interior 9 of the pedestal support base 1. The upwardly directed sidewalls 13 not shown in FIG. 1 provides removal access panel 14 as seen in FIG. 3 to service the concealed components of the air enriched, recirculation venturi air water jet system. The water impervious floor 5 of the pedestal base 1 is designed as a safety feature to capture the water 3 if a leak develops within the interior of the enclosure 10 and within the interior of the pedestal base 1. As a safety feature all electrical components are mounted above the water impervious floor 5. To complete the pedestal support base I as a supportive structure for enclosure 12, and components of the air enriched recirculation Venturi air waterjet massage system. A pedestal support deck 11 made of the same material as the pedestal base 1, as seen in FIG. 3 is placed on the top of the pedestal base 1 upwardly end sidewalls 6 and upwardly directed sidewalls 13.

Figure 4:
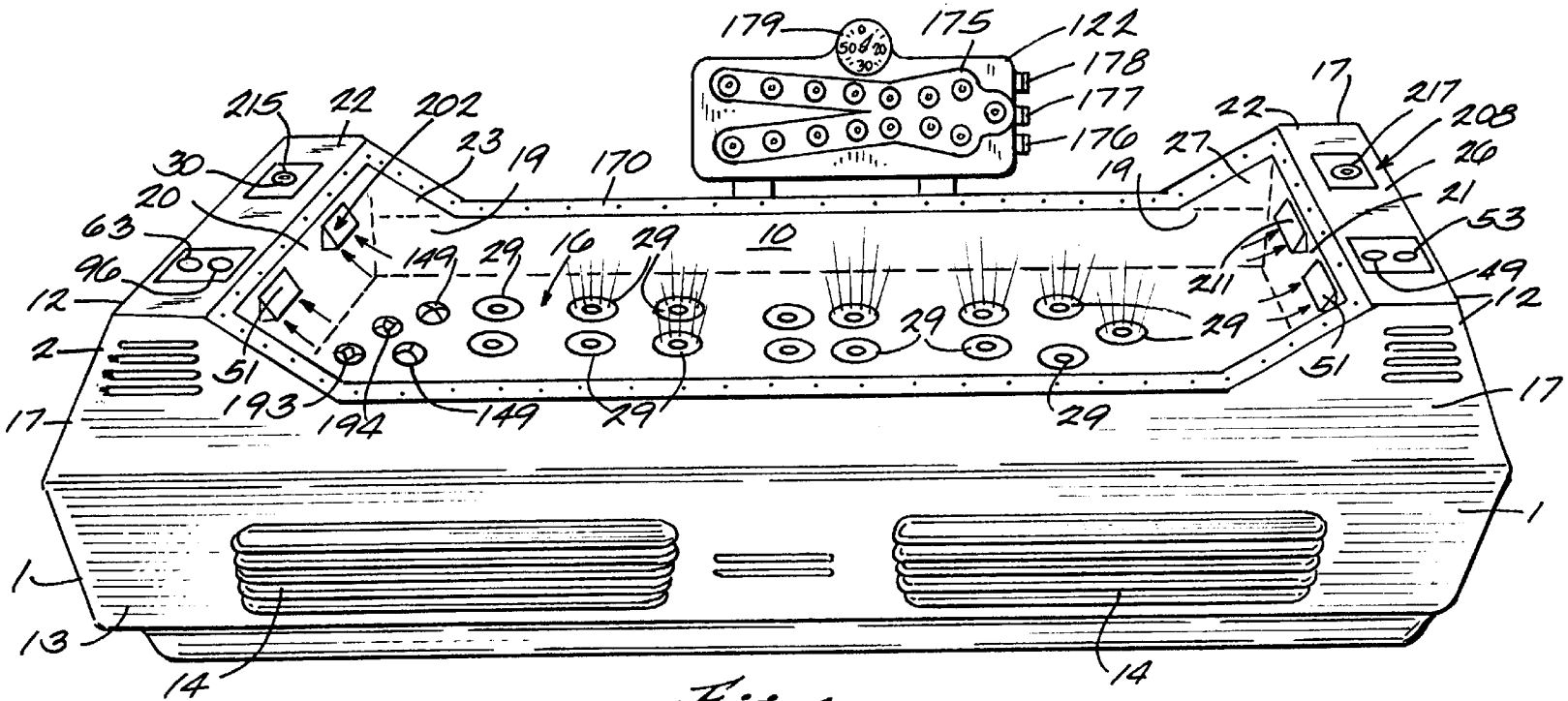
FIG. 4 is a perspective view of the massage bed with the top membrane removed.
Figure 5:
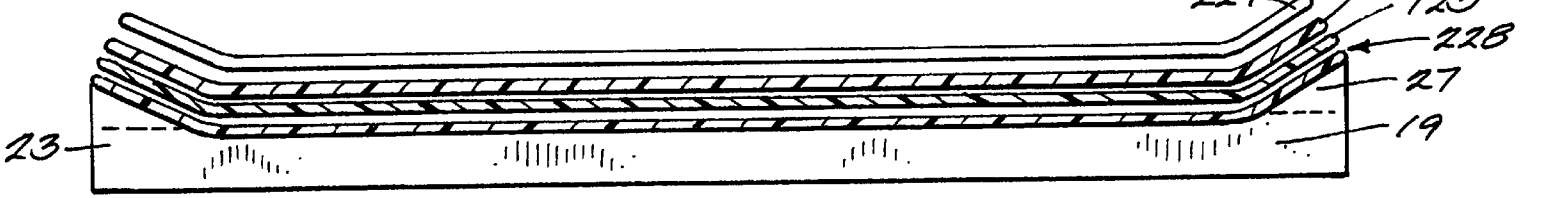
FIG. 5 is a sectional view taken through the upper portion of the massage bed shown in FIG. 4.

Description of the Pedestal Support Means 1 and Enclosure Means 12 As Seen in FIG. 1 and FIG. 4

The pedestal support deck 11 as seen in FIG. 3 has a contoured opening 15 and rectangular openings at head end 24 and foot end 25 for the plumbing means to enter the interior 9 of support base 1 from enclosure means 12. The pedestal support deck 11 is shaped and contoured to the interior enclosure floor 16 so when the enclosure 12 is placed on the top of the pedestal support deck 11, the connection will be uniform providing a flush fit, and a even supportive structure as a whole. The water and air enclosure 10 and pedestal base means 1 as shown in FIG. 1 can be made to various sizes, shapes, and capacities to accommodate and support any size person, and also be constructed of other water impervious material such as metal, wood, vinyl plastic, etc. The enclosure means 12 as seen in FIG. 4 is constructed with an exterior of enclosure 17, and an interior of a water impervious enclosure 10 with a contoured interior enclosure floor 16 and connected upwardly directed interior sidewalls 19 with connected upwardly directed interior foot end sidewall 20, and connected upwardly directed interior head end sidewall 21. The foot end interior sidewall 20 connects to a foot end riser 22 that extends above the interior sidewalls 19 to form an interior foot end air chamber 23. The chamber 23 above the layer of water 3 will permit the ambient air 8 and interior of enclosure air 18 to be received, collected recirculated, balanced, and evacuated by adjustable venturi air waterjet means 29, and interior enclosure air control air relief valve means 30. As seen in FIG. 1, within the interior of the sealed enclosure 10, the head end interior sidewall 21 connects to head end riser 26 that extends above the interior sidewall 19 to form an interior head end air chamber 27. The chamber above the layer of the water 3 will permit the ambient air 8 and the interior of enclosure air 18 to be received, collected, recirculated, controlled, balanced, and evacuated by adjustable venturi air waterjet means 29, and interior enclosure intake air control and interior air relief valve means 30. As seen in FIG. 1, within the interior of the sealed enclosure 10. When smaller size enclosure means 12 are used only one riser and one chamber maybe used, preferably the foot end riser 22 and chamber 23. Although two are seen in FIG. 1 which is the preferred embodiment that allows alternative modes of water, and pressurized air support, and air mixed waterjet therapy when in operation by positioning the person 4 supported on top membrane 123 with pressurized air to raise or lower upper body extremities or to raise or lower, lower, body extremities or raise upper body and lower body simultaneously. Refer now to the interior raised contoured floor 16 as seen in FIG. 1 which is designed to be uniform with the contoured body of the reclining person 4 supported on the top membrane 123 on the layer of water 3 and air 18 or just water 3 or just air 18 to provide and an even distribution of aerated waterjet pressure massage effects 151 to impinge underside of the top membrane 69 and to massage the person 4 supported thereon. The aerated or non aerated waterjet 151 impact impressions 188 to underside of top membrane 69 as seen in FIG. 1 are transferred and seen at top membrane 123.

Figure 2:
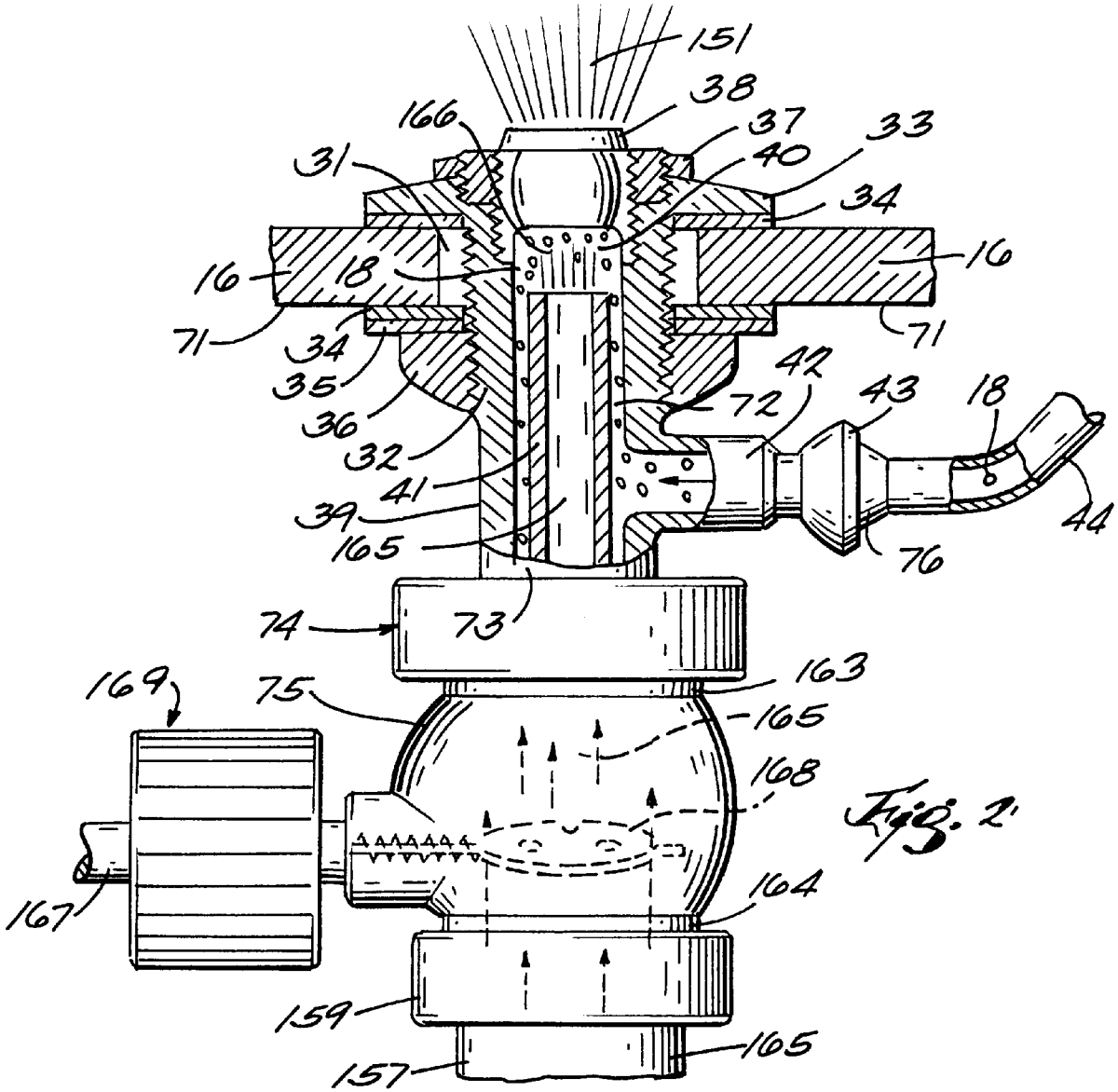
FIG. 2 is a partially sectioned side elevation view of a water/air assembly used in the massage bed.

Description of Drawing FIG. 2 As Seen in FIG. 1 and FIG. 4

Figure 8:
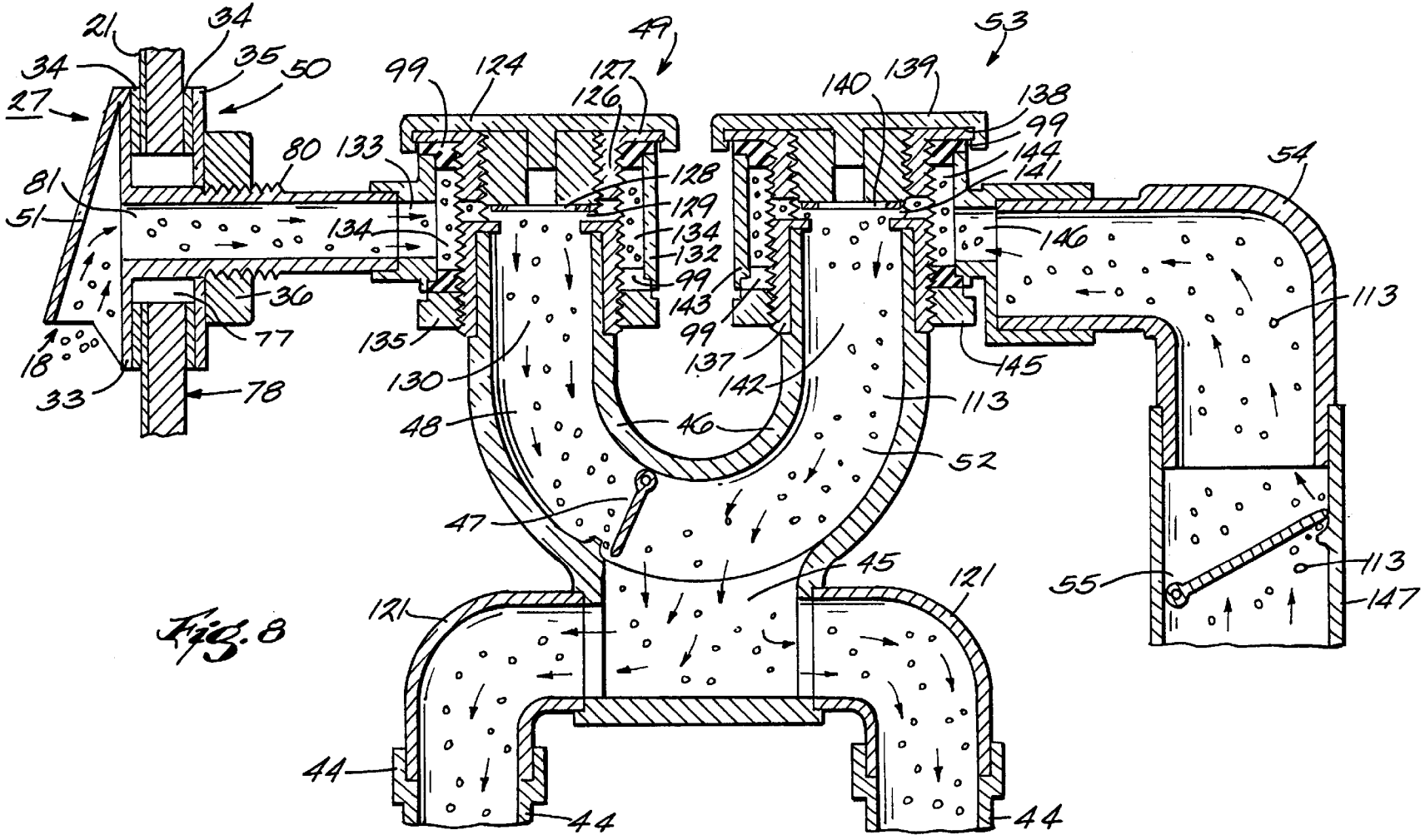
FIGS. 8 and 9 are side elevation right hand and left hand views with parts broken away of the air intake assemblies for circulating air from the enclosure to the water/air assemblies shown in FIG. 2.
Figure 10:
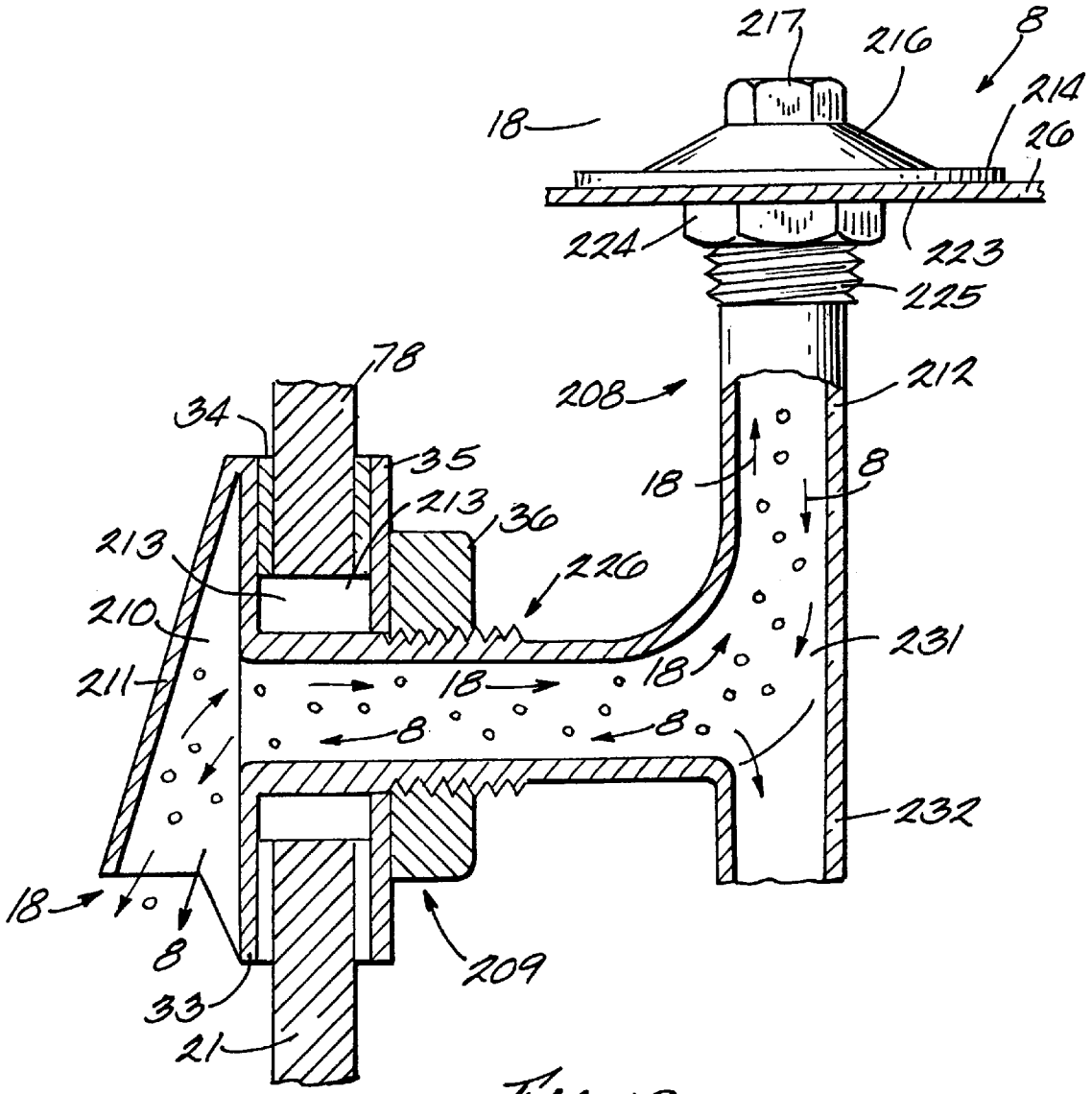
FIGS. 10 and 11 are side elevation views with parts broken away of the right hand and left hand air inlet assemblies for introducing outside air into the system.
Figure 12:
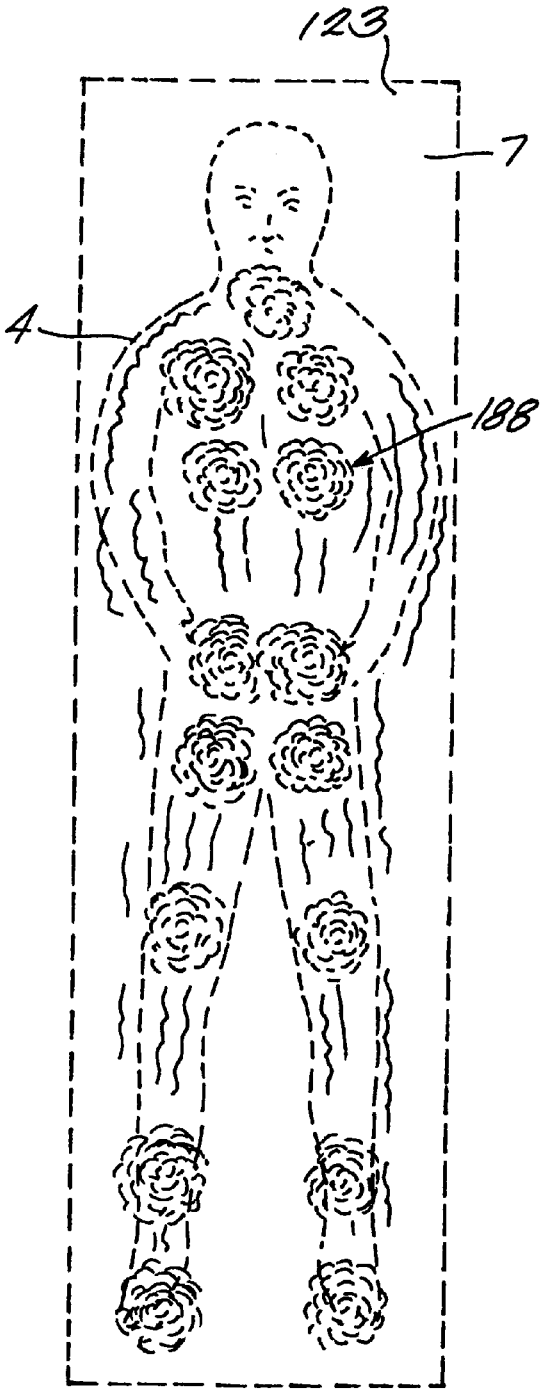
FIG. 12 is a partially schematic top plan view of the massage bed in operation showing the massage effects areas on the top membrane (with the person receiving the massage outlined in dotted lines)
Figure 13:
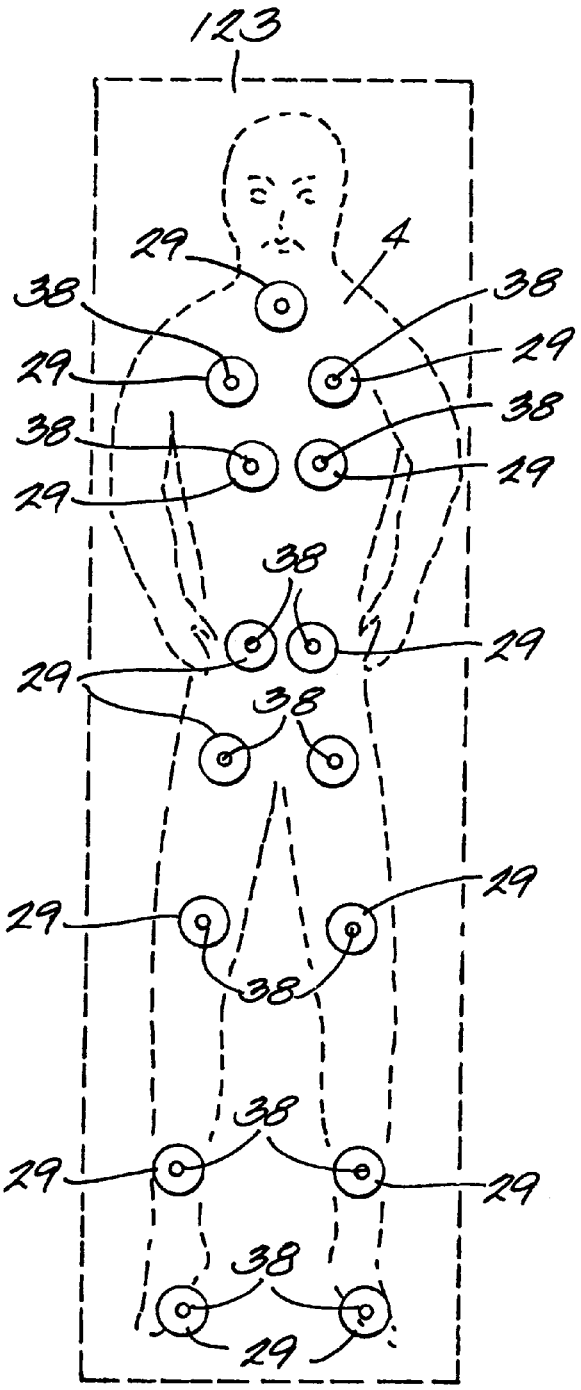
FIG. 13 is a view similar to FIG. 12 but with the massage bed in inoperative condition showing the plurality of spaced water/air inlets.

FIG. 2 shows a detailed section view of components of preferred embodiment one of fifteen on/off electronic actuator control valve waterjet inlet fitting assembly 29 (a less or higher number of waterjet inlet assemblies 29 maybe used in the system) and the manner in which it is anchored to interior enclosure contoured floor 16. FIG. 2 number 29 shows components identified by numbers as follows, the inlet threaded bodied fitting 32 with seal flange 33 water proof PVC gasket 34, PVC hard washer 35 compression lock nut 36 threaded lock ring 37 and adjustable secondary low pressure 360° directional inlet nozzle 38 (In operation ported nozzle 38 provide preselected adjustment to target the produced air mixed water jet to massage a specific muscle group area of the person 4 supported on the top membrane 123) as seen in FIGS. 1 and 12. The inlet threaded bodied fitting 32 provides a sealing means within the interior enclosure floor 16 as seen in FIG. 2 as shown there in aperture 31 through which the inlet threaded bodied fitting 32 extends as seen in FIG. 1. The aperture 31 is slightly larger than the threaded portion of the inlet fitting 32 to provide insertion through aperture 31. The flange 33 of the inlet bodied fitting 32 is larger than the aperture 31 (to provide a seal means). A PVC water proof gasket 34 fits just around the threaded portion of inlet bodied fitting 32 and pushed upwardly against the underside of the inlet bodied fitting seal flange 33 (other type gasket material maybe used such as silicone sealant). The inlet bodied fitting 32 is then inserted through the aperture 31 the PVC water proof gasket 34 and sealed flange 33 is captured against the interior enclosure contoured floor 16. The hard PVC washer 35 fits just around the portion of the inlet bodied fitting 32, and pushed upwardly. Against the underside of the exterior contoured floor 71 a lock nut 36 threadingly engages the threaded body portion of the inlet fitting 32, and tightened against the underside of exterior floor 71 to sealingly clamp the inlet bodied fitting seal flange 33 to the interior enclosure contoured floor 16 by compression means. There is a connected venturi tee bodied fitting 39 with connected internal air and water mixing chamber 40 and primary internal fitting nozzle 41 which rises just above the connected internal air chamber 72 and internal air intake port 42 with connected check valve 43 connected to air piping 44. In one mode of operation the venturi tee bodied fitting 39 produces an aspirator effect within internal air chamber 72 (as shown in FIG. 2) as pressurized water 165. (Imparted by water pump means 148 as shown in FIG. 2 as seen in FIG. 1) emanates from, internal primary ported nozzle 41 producing a primary water jet 166, at high velocity past air intake internal air chamber 72 orifice 42 creating a suction effect within air chamber 72 orifice 42 and connected air intake side 76 of check valve 43 and connected air intake piping 44 (in off mode of operation, the check valve 43 prevents interior enclosure water 3 that settles into internal air chamber 72 from entering connected air intake piping 44 (leaving an open chamber of air 18 as shown in FIG. 2). The connected intake air piping 44 as seen in FIG. 1 and previously described is connected to air intake ports 121 of air intake header manifold system 45 connected to head end riser 26. Two-way air intake and pressurized air delivery manifold system 46 is provided. The manifold system 45 is connected to one way air intake side 48 of two way manifold 46. There is a connected check valve 47 connected to on/off air intake control valve assembly 49 connected to interior enclosure air intake threaded bodied fitting assembly 50 in the on mode of operation as previously described with reference to FIGS. 1 and 2. The aspirator aerated effect by waterjet assembly 29 creates a suction within air chamber 72 sucking out the settled water 3 as previously described and opening air intake side 76 of connected check valve 43 instantly providing air 18 to mix with waterjet 166 in mixing chamber 40. To massage specific muscle mass areas of the body, refer now to the pressure side 52 of two-way manifold 46, with connected one way to on/off air pressure control valve assembly 53. The control knob 139 of control valve assembly 53 is in off position (inactive) closing off pressure side 52 of pressurized air delivery system, thus allowing the withdrawal of air 18 throughout sealed interior enclosure 10 intake assembly 50 at a controlled flow rate throughout (producing a balanced vacuum effect within sealed enclosure 10.) The check valve 47 during the recirculation mode is opened by the aspirator effects created by waterjet means 29 in operation to cause the recirculation of sealed interior enclosure air 18 throughout venturi waterjet means 29. The control knob 124 of control valve assembly 49 maybe closed to allow alternative mode of operation by super charging the venturi waterjet inlet assembly means 29 thus adding higher velocity to the aerated waterjet 151 or waterjets 151 as seen in FIGS. 1 and 2 producing aerated jet pressure massage effects to the supported person 4. Referring back to check valve 47, the check valve 47 shuts off and works as a safety feature and prevents pressurized air 113 produced by air pump means 85 in operation from entering interior enclosure 10 through intake side 48 of two way manifold 46. The pressurized air is fed directly through associated Intake piping 44, and through check valve 43 mixing with primary water jet 166 at mixing chamber 40 providing a high velocity aerated waterjet 151 that drives upwardly though low pressure secondary directional nozzle 38 through a layer of water 3 only or a layer of water 3 and air 18 or just air 18. The air is then captured in air chambers 23 and 27 and calibrated for recirculation through out air pump means 85 and back through venturi waterjet assembly 29. Air 18 can be removed from interior enclosure 10 into ambient air 8. The air 18 within the interior of enclosure 10 can also be calibrated to balance the person in alternative positions for massage therapy by regulating foot end interior enclosure intake air control and interior air relief valve means 30, and head end interior enclosure intake air control and interior air relief valve means 208. Note: Interior enclosure intake air control 30 means at foot end and interior enclosure intake air control 208 at head end can also be opened to inflate interior enclosure 10. By regulating control valve knobs 204 and 216 in operation aerated waterjet means 29 will also suck in ambient air 8 pressurizing the interior enclosure 10. Referring back to check valve 47, when opened, the aspirator effects produced by water jet means 29 in operation with supercharging mode in off position the interior enclosure air 18 us then sucked through intake manifold 45 intake ports 121. The enclosure interior air 18 is then mixed with waterjet 166 emanating from primary nozzle 41 in mixing chamber 40 and out through secondary directional low pressure nozzle 38 producing aerated water jets 151 that drives through the layer of interior enclosure water 3 producing aerated jet pressure massage effects 188 to the person 4 supported on top membrane 123. The air from aerated water jets 151 is then recaptured in chambers 27 and 23 and withdrawn by waterjet means 29 for recirculation through out the sealed massage system. Detailed description of safety air relief valve 217 as seen in FIG. 1 and FIG. 10. Safety air relief valve 217 as shown in detailed section view of FIG. 10 as shown in FIGS. 1, 3, is designed to assure safety within the sealed interior enclosure 10. When in super charging mode of operation delivering pressurized air throughout pressurized air delivery system 53 (head end) and pressurized air delivery system 63 at foot end into interior enclosure 10 produced by air pump means 85 and through associated piping 44, 57, 90, & 147 as shown in FIG. 1. If the sealed interior enclosure 10 over inflates with pressurized air the safety air relief valve 217 will open and release the pressure providing a safe therapy session. FIG. 8 shows the manner in which the control valve 49 is anchored to head end riser 26. The head end riser 26 has aperture 125 through which the air intake control valve assembly 49 extends. The assembly 49 has a inlet, outlet threaded bodied fitting 126 and seal flange 127 with connected control knob 124 with connected gate valve 128 with connected vent opening 129. The control knob 124 opens and closes the gate valve 128 to regulate the amount of interior enclosure air 18 entering vent 129 and exiting outlet port 130 of the seal flange 127. The outer internal chambered inlet housing 132 is larger than control valve vented threaded bodied fitting 126 to form a separate outer sealed internal chamber 134 separate from bodied fitting vent 129 when internal inlet chambered housing 132 is placed.

Over and around the threaded bodied fitting 126 and pushed upwardly, the top side of housing 132 connects to o-ring seal 99. A second o-ring 99 fits just around threaded bodied fitting 126 and pushed to the underside of chambered housing 132. A compression lock nut 135 threadingly engages threaded bodied fitting 126 and tightened to sealingly clamp the fitting flange 127 and air intake control valve fitting assembly valve fitting assembly 49 to head end riser 26. The chambered housing 132 inlet port 133 is connected to interior enclosure air intake fitting assembly 50, as shown in FIG. 8. The interior enclosure air intake bodied fitting assembly 50 provides a sealingly means within the interior enclosure 10 head end sidewall 21 at chamber area 27 above the layer of water 3 to provide controlled interior enclosure air 18 evacuation and recirculation of air 18. Throughout the aerated waterjet means 29, and through the layer of water 3 and captured within the chambered area 27 above the layer of water 3 within layer of water 3 within the sealed enclosure 1 0 and in one continuous cycle. As shown is an aperture 77 through which interior enclosure venturi air intake threaded bodied fitting 80 extends, the aperture 77 is slightly larger than the threaded portion of the intake fitting 80 to provide insertion through aperture 77. The flange 33 is larger than the threaded portion of the intake bodied fitting 80 and aperture 77 to provide a seal means. A PVC water proof gasket 34 fits just around the thread portion of the intake bodied fitting 80, and pushed against the underside of the outlet bodied fitting flange 33 (Other type sealing material may be used such as silicone sealant). The venturi intake threaded bodied fitting 80 is inserted through aperture 77. The PVC water proof gasket 34 and seal flange 33 is captured against the interior enclosure head end sidewall 21. A chamber area 23, a PVC hard washer 35 fits just around the threaded portion of the intake bodied fitting 80, and is pushed against the exterior enclosure sidewall 78 a compression lock nut 36 threadingly engages the thread portion of the intake fitting 80 and tightened against the exterior wall 78 to sealingly clamp the venturi intake seal flange 33 to the interior enclosure head end sidewall 21 chambered area 23 by compression means. A tapered channeled vent 51 is attached to internal opening 81 of venturi interior air intake fitting assembly 50 to prevent the pliable top membrane 123 from sealing off the internal opening 1 by the vacuum effect produced by the venturi waterjet means 29 when in recirculation mode of operation, as seen in FIG. 1. As shown venturi air inlet chambered manifold 45 is connected to two way venturi interior enclosure intake and pressurized manifold system 46. (As previously described). Now join pressurized air side 5-2 of two way manifold 4-6 with connected outlet port 142 of valve assembly 53 as shown in FIG. 8. The adjustable air pressure control valve assembly 53, and the manner in which it is anchored to head end riser 26 will now be described with reference to fragmentary detailed section view. Riser 26 has aperture 136 through which the air pressure control valve assembly 53 extends. The assembly 53 has a inlet outlet bodied fitting 137 and seal flange 138 with connected control knob 139 with connected gate valve 140 with connected vent opening 141. The control knob 139 opens and closes the gate valve 140 to regulate the amount of pressurized ambient air 113 produced air pump means 85 entering the vent 141 and exiting the outlet port 142. The seal flange 138 is larger than aperture 136 and captured against top side of head end riser 26 a o-ring seal 99 (of assembly 53) fits just around the inserted control valve threaded bodied fitting 137 and pushed upwardly against the underside of exterior head end riser 131. The outer internal chambered inlet housing 143 is larger than control valve vented threaded bodied fitting 137 to form a separate outer sealed internal chamber 144. When outer internal chambered housing 143 is placed over and around the threaded bodied fitting 137 and pushed upwardly, the top side of housing 143 connects to o-ring seal 99 against underside of exterior head end riser 131. A second o-ring 99 fits just around threaded bodied fitting 137 and pushed against the underside of chambered housing 143. A compression lock nut 143 threadedly engages threaded bodied fitting 137 and tightened to sealingly clamp the fitting flange 127 and inlet, outlet adjustable air pressure control valve assembly 53 to head end riser 26.

The inlet port 146 of pressure control valve assembly 53 is connected to 90° elbow fitting 54 connected to check valve 55. The check valve 55 and vertical connected air piping 147 that rises above the water level prevents the (safety feature) interior enclosure water 3 from backing up into vertical piping 147 and air pump means 85. The downwardly vertical piping 147 is connected to union disconnect 82. The disconnect union 82 provides the enclosure means 17 and pedestal means 1 to be connected and disconnected during assembly and disassembly, and when servicing the water massage unit as seen in FIG. 1 the disconnect unions also provide a seal means at the connection.

Figure 9:
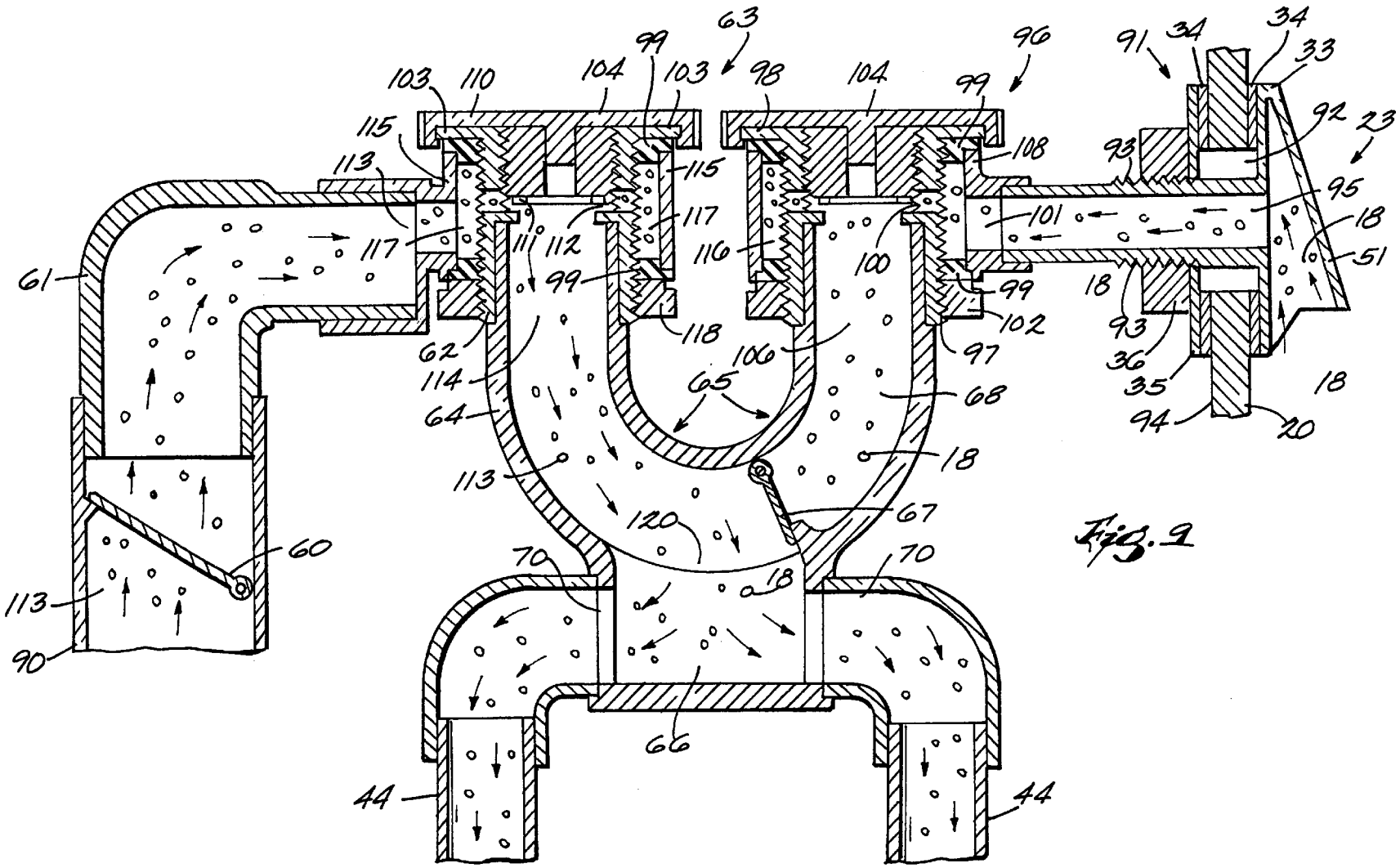

Refer now to two way diverter tee pipe fitting 56 as previously described connected to foot end pipe lead 57, connected to upwardly directed elbow 58 connected to disconnect union 88 connected to upwardly directed piping 90 connected to check valve 60. Check valve 60 prevents interior enclosure water 3 from entering air pump means 85. Refer now to pressurized air side 64 of two way manifold system 65, as seen in detailed section view of FIG. 9 connected to inlet elbow fitting 61. Connected to adjustable air pressure control valve assembly 63, the control valve assembly 63 and the manner in which it is anchored to foot end riser 22 will now be described with reference to FIG. 9 as shown. The foot end riser 22 has aperture 119 through which the air pressure control valve assembly 63 extends. The assembly 63 has a inlet outlet bodied fitting 62 and seal flange 103 with connected control knob 110 with connected gate valve 111 with connected vent opening 112 the control knob 110 opens and closes the gate valve 111 to regulate the amount of pressurized ambient air 113 entering vent 112 and exiting the outlet port 114. The seal flange 103 is larger than aperture M and captured against top side of foot end riser 22 a o-ring 99 (of assembly 63) fits just around the inserted control valve threaded bodied fitting 62 and pushed upwardly against the underside of exterior foot end riser 107. The outer internal chambered inlet housing 115 is larger than control valve vented threaded bodied fitting 62 to form a separate outer sealed internal chamber 117 when outer internal chambered housing 115 is placed over and around the threaded bodied fitting 62 and pushed upwardly. The top side of housing 115 connects to o-ring 99 against underside of exterior foot end riser 107. A second o-ring 99 fits just around threaded bodied chambered housing fitting 62 and pushed against the underside of chambered housing 115. A compression lock nut 118 threadingly engages threaded bodied fitting 62, and tightened to sealingly clamp the fitting flange 103 and inlet outlet adjustable air pressure control valve assembly 63 to foot end riser 22. The outlet port 114 (of control valve assembly 63) is connected to one way pressurized air side 64 of two way manifold 65 connected to venturi air intake air chambered header manifold 66. Refer now to venturi interior enclosure air 18 intake side 68 of two way manifold system 65 and the manor in which it is anchored to interior enclosure sidewall 20 and foot end exterior riser 22. The interior enclosure venturi air 4=11? fitting assembly 91 provides a sealingly means within the interior enclosure foot end sidewall 20 at air chamber area 23 above the layer of water 3 to provide controlled interior enclosure air 18 evacuation, and recirculation of air 18 throughout the venturi air intake waterjet means 29 within the sealed enclosure 10 in a continuous cycle as seen in FIG. 1 and FIG. 9. As shown is a aperture 92 through interior air intake threaded bodied fitting 93 extends the aperture 92 is slightly larger than the threaded portion of the intake fitting 93 to provide insertion through aperture 92. The flange 33 is larger than the threaded portion of the intake fitting 93 and is larger than aperture 92 (to provide a seal means). A PVC water proof gasket 34 fits just around the portion of the intake bodied fitting 93 and pushed against the underside of the outlet bodied fitting flange 33 (other type sealing material maybe used such as silicone sealant). The venturi intake threaded bodied fitting 93 is inserted through aperture 92. The PVC water proof gasket 14, and seal flange 33 is captured against the interior enclosure head end sidewall 20 chamber area 23 a PVC hard washer 35 fits just around the threaded portion of the intake bodied fitting 93 (a silicone sealant maybe used to seal any voids around aperture 92 of exterior enclosure sidewall 94 and bodied fitting 93). Pushed against the exterior enclosure sidewall 94 is a compression lock nut 36 threadingly engages the thread portion of the outlet fitting 93, and tightened against the exterior wall 78 to sealingly clamp the venturi outlet fitting gasket 34, and flange 33 to interior enclosure foot end sidewall 20 chamber 23 by compression means.

A tapered venturi air evacuation vent guard 51 is attached to seal flange 33 to guard the underside of the top membrane 69 from being sucked into internal opening 95 of venturi intake bodied fitting 91, as seen in FIG. 1. A controlled vacuum effect is produced within the sealed interior enclosure 10. During an alternative mode of operation produced by adjustable venturi air and water jet inlet means 29 refer again to foot end interior enclosure sidewall with connected sealingly clamped venturi air intake threaded bodied fitting assembly 91 with connected inlet outlet venturi air chambered. Air control valve fitting assembly 96 and the manner in which is anchored to foot end riser 22 will now be described with reference to FIG. 9. As shown, the foot end riser 22 has aperture 105 through which the inlet, outlet air control valve threaded bodied fitting assembly 96 extends the assembly 96 has an inlet outlet threaded body fitting 97 and seal flange 98 with connected control knob 104 and connected gate valve 109 with connected vent opening 100, the control knob 104 opens and closes the gate valve 109 to regulate the amount of interior enclosure air 18 entering vent 100 and existing outlet port 106. The seal flange 98 is larger than aperture 105 and captured against top side of foot end riser 22. An o-ring seal 99 fits just around the inserted control valve threaded bodied fitting 27 and pushed upwardly against the underside of exterior foot end riser 107. The outer internal chambered inlet housing 108 is larger than control valve vented threaded bodied fitting 97chamber 116 separate filter sealed internal chamber 116 separate from bodied fitting vent 97 when internal inlet chambered housing 108 is placed over and around the threaded bodied fitting 97.

The top side of housing 108 connects to o-ring seal 99. A second o-ring 99 fits just around threaded bodied fitting 97 and is pushed against the underside of chambered housing 108. A compression lock-nut 102 threadingly engages threaded bodied fitting 97 and is tightened to sealingly clamp the fitting flange 98, and inlet, outlet, Venturi air control valve fitting assembly 96 to foot end riser 22. The chambered housing 108 inlet port 101 is connected to interior enclosure venturi air intake fitting assembly 91.

Refer now to outlet port 106 of intake venturi air control valve fitting assembly 96 (as seen in FIG. 1 and FIG. 9). Check valve 68 is connected to air intake chambered header manifold 66. Refer now to detailed section view FIG. 9, the pressurized side 64 and venturi air intake side 68 of two way manifold 65 as previously described now join intake side 120 of header manifold 6-6 with connected outlet ports 70 connected to a group of intake piping 44 connected to neck 76 of check valve 43 connected to venturi tee fitting suction orifice 42 of an array of adjustable venturi air and water jet inlet fitting assemblies 29 anchored and sealing clamped to the interior enclosure contoured floor 16.

Description of Water Jet Control Panel 122 Electronic Scanning System as Seen in Illustrative Drawing FIG. 15

To provide a manual control mode of on/off operation, and pressure control to anyone or more of the f if teen electronically activated aerated water jet control valve inlet assemblies 29 mounted in the interior enclosure floor 16. The electronic manual switching 175 may also be programmed automatically at switch 177 to activate or deactivate any one or more of the fifteen water jet inlet assemblies 29 mounted in the interior enclosure contoured floor 16 at preselected locations. The manual and automatic modes of operation will provide trigger point massage therapy by aerated water jet means 29 to anyone or more muscle mass areas of the person supported on the top membrane 123. The control panel 122 also provide a water pressure control switching 178, which allows the main electronic actuator control valve 162 to open and stop at a desired flow rate of water pressure 165 that is measured by pressure gauge 179 located at top of control panel 122. The electronic activator pressure control valve 162 as seen in FIG. 1 has connected coupler union 184 connected to discharge side 185 of water pump 148 with connected union coupler 161 connected to manifold header system 158 with connected outlet ports 160 connected to header outlet feeder piping 157 as previously described in reference to FIG. 2.

As described with reference to detailed section view as seen in FIG. 2, water flowing through internal control valve 75 is controlled by gate 168 to close, open or stop at desired variable flow rate mode of operation. The gate 168 is ported at a calibrated opening to allow continuous flow 165 through the gate 168 to prevent a dead head affect during the gate 168 closing mode of operation. The gate 168 is electronically activated through connected cable 167 extending from electrical control unit 169. This control unit 169 has an outside connected electrical power supply cable 173 as seen in FIG. 1 with connected external plug 174 which is connected to outside electrical power supply source. Electrical control unit 169 also includes internal electronic and pneumatically activated electrical relays time devices and control switches (not shown) which are controlled from scanner control panel 122 that is mounted to exterior enclosure top side rail 170 as seen and described with reference to FIGS. 1,4, and 15. This control panel 122 has fifteen connected electrical switches 175 which are connected to electrical cable 171 extending from electrical control unit 169 which are connected (not shown) to relays timing devices and switching in conjunction with connected electronic actuator control valve 75 as previously described in FIG. 2 to provide a manual control mode, of pressurized water 165 control operation to any one or more of the fifteen electrically activated aerated water jet control valve inlet assemblies 29. The electrical manual switching 175 may also be programmed automatically at switching 177 to activate of deactivate any one or more of the fifteen water net inlet assemblies 29 mounted in the interior enclosure contoured floor 16 at pre selected locations. The manual and automatic modes of operation will provide trigger point massage therapy, by aerated water jet means 29 to any one or more muscle mass areas of the person 4 supported on the top membrane 123. The control panel 122 also provides a water pressure control switching 178 which allows the main electronic actuator control valve 162 gate (not shown) to open and stop at a desired flow rate of water pressure 165 that is measured by pressure gauge 179 located at top of control panel 122. The electronic activator pressure control valve 162 as seen in FIG. 1 has connected coupler union 184 connected to discharge side 185 of water pump 148 and with connected union couplers 161 connected to manifold header system 158 and with connected header outlet ports 160 connected to header outlet feeder piping 157 as previously described in reference to FIG. 2.

Reference Numbers

1. Pedestal Support Means
2. Acrylic Formed Enclosure, Base Means, with Bonded Fiberglass & Resin
3. Water (Interior Enclosure)
4. Person
5. Pedestal Floor
6. Pedestal Base Side End Walls
7. Air Vents
8. Ambient Air
9. Interior of Pedestal Support Means
10. Interior of Sealed Enclosure
11. Pedestal Support Deck
12. Enclosure Means (Water & Air)
13. Upwardly Directed Side Walls (Pedestal Support means)
14. Access Panels, of Pedestal Support Base 1
15. Pedestal Support Deck Contoured Floor Opening
16. Interior Enclosure Raised Contoured Floor
17. Exterior of Enclosure
18. Interior of Enclosure. (Air)
19. Interior Side Walls
20. Foot end Interior Enclosure Side Walls
21. Head end Interior Enclosure Side Walls
22. Foot end Riser
23. Interior Foot end Air Chamber
24. Rectangular Head end Opening. See FIG. 3
25. Rectangular Foot end Opening. See FIG. 3
26 Head end Riser
27. Interior Head end Chamber
28. Top Membrane Sealing Means, Retainer Strip (FIGS. 1, 4, 5, 6, and 7)
29. On/Off Electronic Actuator Control Valve & Venturi Water jet Inlet Fitting Assembly, as seen in FIGS. 1 and 2
30. Foot end Interior Enclosure Intake Air Control & Interior Air Relief Assembly
31. Aperture. As seen In FIG. 2
32. Inlet Threaded Flange Bodied Flange Fitting
33. Seal Flange
34. PVC Water Proof Gasket
35. PVC Hard Washer

36. Compression Lock Nut
37. Threaded Lock Ring (Locks 360° Secondary Nozzle 38 in place) Adjustable
38. Secondary (Low Pressure) 360° Directional Ported Nozzle Adjustable) of Water Jet Inlet Assembly 29
39. Venturi Tee Bodied Fitting Assembly
40. Internal Air & Water Mixing Chamber, of Bodied Fitting 32
41. Primary Inlet Internal Ported Nozzle
42. Internal Venturi Tee (Air Intake Port)
43. Check Valve, (of WaterJet Inlet Assembly 29)
44. Air Intake Pipe (Chambered) (of Water Inlet Assembly 29)
45. Air Intake Manifold Header System (Head end)
46. Head end Two Way Air Intake Pressurized Air Manifold System
47. Check Valve. (Air Intake Side 48, of Two Way Manifold System Head end
48. One Way Air Intake Side of Two Way Manifold 46. Head End
49. Interior Enclosure On/Off Air Intake Control Valve Fitting Assembly With Control Knob 124
50. Head end Interior End Side Wall Enclosure Venturi Air Intake Threaded Bodied Fitting Assembly
51. Tapered Venturi Air Intake Evacuation Vent & Guard (head end of assembly 50 & 91
52. Pressurized Air Side of Manifold 46 (Super Charged) Head end
53. Inlet Outlet Adjustable Air Pressure Control Valve Assembly
54. 90° Elbow Pipe Fitting Pressure Side 64 of Two Way Manifold 46
55. Check Valve. (Pressure Side 52) of Two Way Manifold 46 control valve 53 head end
56. Two Way Diverter Tee Pipe Fitting (With Inlet Port)
57. Horizontal Piping (foot end lead) Pressure Side of Air Pump Means 85
58. Elbow Fitting Foot end
59. Air Intake Vent (Radiator Cooling Means 192)
60. Check Valve, Pressure Side 64 of Two Way Manifold 65 Control Valve 63 Foot end
61. 90° Elbow Fitting of Valve Assembly 63
62. Inlet Outlet Threaded Bodied Fitting (of Assembly 63)
63. Inlet Outlet On/Off Adjustable Air Pressure Control Valve Assembly
64. Pressurized Air Side of Two Way Manifold 65 (Supercharged) Foot end
65. Foot end Two Way Air Intake Pressurized Air Manifold System
66. Air Intake Chambered Header Manifold With Connected Outlet Ports 70 Foot end
67. Check Valve intake Side 68 of Two Way Manifold System 65 Foot end
68. Interior Enclosure (Recirculating) Air Intake Side of Two Way Manifold 65 Foot end
69. Underside of Top Membrane
70. Intake Ports of Air Intake Header Manifold System 66
71. Underside of Exterior Contoured Floor
72. Internal Air intake Chamber (of Venturi Tee Bodied Fitting 39
73. Inlet Port (of Venturi Tee Bodied Fitting 39)
74. Union Coupler (of Venturi Tee Bodied Fitting 39)
75. On/Off Electronic Actuator Control Valve Assembly 29 (See FIGS. 1 and 2)
76. Air Intake Side of Check Valve 43. (of Air Piping 44)
77. See Aperture. FIG. 8. (Interior Enclosure) (Head end Sidewall Chamber Area 27)
78. Exterior of Enclosure End Side Wall (Head end)
79. Reservoir
80. Interior Enclosure Venturi Air Intake Fitting Assembly (Head end)
81. Internal Opening (of Air Intake Fitting Assembly 50)
82. Union Disconnect (Head end Riser Pipeline)
83. Union Disconnect (Foot end Lead) of Air Pump Means
84. Union Disconnect (Discharge Side of Air Pump)
85. Super Charger (Air Pump Means)
86. Vertical Elbow Disconnect (Suction Side of Air Pump Means)
87. Horizontal Piping Connected To Air Vent (To Receive Outside Air Connected From Air Pump Means 85)
88. Disconnect Union
89. Discharge Side of Supercharger, (Air Pump Means 85)
90. Upwardly Directed Piping. (Vertical)
91. Interior Enclosure Venturi Air Intake Threaded Bodied Fitting Assembly)
92. See (Aperture) FIG. 9 Interior Enclosure (Foot end Sidewall)
93. Interior Enclosure Venturi Air Intake Bodied Fitting (Foot end)
94. Exterior Enclosure Sidewall (Foot end)
95. Internal Opening of Venturi Air Intake Threaded Fitting 93
96. Intake Venturi Air Chambered Control Valve Fitting Assembly (Foot end)
97. Control Valve Bodied Fitting (of Assembly 96)
98. Fitting Flange (of Assembly 96)
99. O-Ring Seal. (of Assembly 93, 63, 19, 53.)
100. Vent (Control Assembly 96)
101. Chambered Housing Inlet Port (of Valve Assembly 96)
102. Lock-Nut (of Valve Assembly 96)
103. Seal Flange (Valve Assembly 63)
104. Control Knob (of Valve Assembly 96)
105. Aperture For Valve Assembly 96
106. Outlet Port (of Valve Assembly 96)
107. Foot End Riser (Underside Exterior)
108. Outer Chambered Housing With Inlet Port 101 (of Assembly 96)
109. Gate Valve (of Assembly 96)
110. Control Knob (of Assembly 63)
111. Gate Valve (of Assembly 63)
112. Vent (of Control Valve Assembly 63)
113. Pressurized Ambient Air (By Air Pump Means 85)
114. Outlet Port (of Valve Assembly 63)
115. Outer Internal Chambered Housing (of Valve Assembly 63)
116. Internal Chamber of Housing 108 (of Intake Valve Assembly 96)
117. Internal Chamber (of Housing 115) (of Valve Assembly 63)
118. Compression Lock—Nut (of Assembly 63)
119. Aperture For Control Valve Assembly 63
120. Air Intake Side of Header Manifold 66
121. Intake Ports (of Intake Header Manifold 46)
122. Water Jet Control Panel Scanning System (Electronic)
123. Top Membrane (Transparent)
124. Control Knob (of Intake Control Valve Assembly 49)
125. Aperture (Head end Riser Intake Valve 49)
126. Inlet Outlet Threaded Bodied Fitting of Assembly 49
127. Seal Flange (Control Valve 49)
128. Gate Valve (Control Valve Bodied Fitting 49)
129. Vent Opening (Control Valve 49)
130. Intake Port of (Control Valve 49)
131. Head end (Underside of Head end Exterior Riser)
132. Outer Chambered Housing (with Inlet Port 133)

Figure 14:
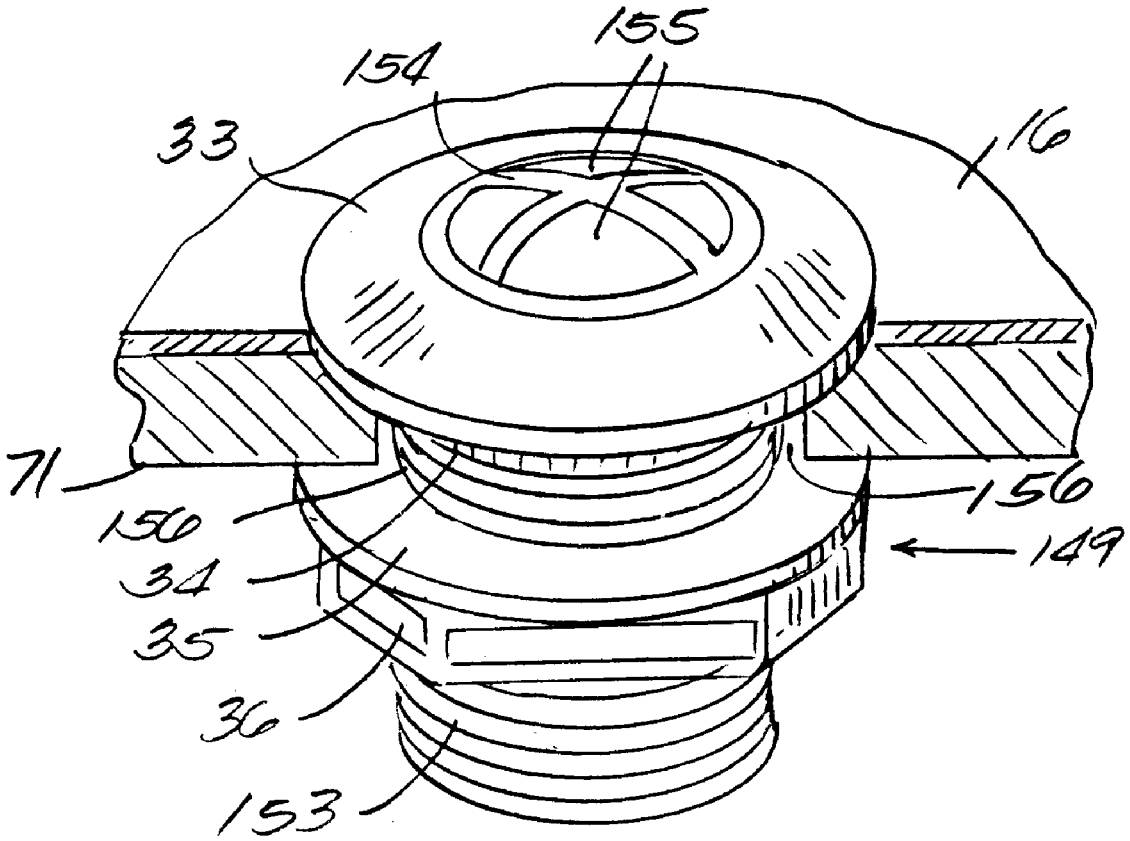
FIG. 14 is a perspective view of a water outlet fitting through which water is drawn from the enclosure when the massage bed is in operation.

133. Inlet Port Chambered Housing (of Control Valve Assembly 49)
134. Internal Chamber (of Housing 132)
135. Compression Lock nut (Valve Assembly 49)
136. Aperture (Head end Riser 26 of control Valve 53)
137. Inlet, Outlet Threaded Bodied Fitting (of assembly 53)
138. Seal Flange (Pressure Control Valve Assembly 53)
139. Control Knob (Pressure Control Valve Assembly 53)
140. Gate Valve (Pressure Control Valve Assembly 53)
141. Vent of (Pressure Control Valve Assembly 53)
142. Outlet Port (of Pressure Control Assembly 53)
143. Outer Internal Chambered Housing (of Valve Assembly 53)
144. Internal Chambered of Housing 143 of Valve Assembly 53
145. Compression Lock nut (Pressure Valve Assembly 53)
146. Inlet Port (of Outer Internal Chambered Housing 143)
147. Vertical Piping. (Connected To Air Means 85)
148. Water Pump Means
149. Outlet Fitting Assembly (Larger Volume)
150. Aerated WaterJets, Within WaterJet-Assembly 29
151. Aerated Waterjet (Or Aerated Waterjets) 360° Directional
152. Suction (Intake) Side of Water Pump
153. Water Outlet Port of Outlet Threaded Bodied Assembly 149 (FIG. 14)
154. Safety Grate of Outlet Fitting Assembly 149
155. Internal Opening of Water Outlet Threaded Bodied Fitting Assembly 149
156. Aperture (Outlet Assembly 149)
157. Manifold Header Outlet Feeder Piping
158. Manifold Header System
159. Union Coupler (of Control Valve 75)
160. Manifold Header Outlet Ports (of Manifold System 158)
161. Union Coupler (Manifold Header System 158)
162. Main Pressure Control Valve (Discharge Side of Water Pump)
163. Outlet Port, (of Electronic Control Valve 75)
164. Inlet Port (of Electronic Control Valve 74)
165. Pressurized Water (Imparted By Water Pump Means 148)
166. Pressurized Air Mixed WaterJet (Or Just WaterJet)
167. Electronic Control Valve Cable. (Electrical)
168. Internal Gate (of Valve Assembly 75)
169. Electronic Control Unit
170. Exterior Enclosure Top Side Rail (of Interior Sidewall 19)
171. Electrical Cable (of Control Panel 122)
172. Pneumatic (Air) Lines of Control Panel 122
173. Outside Electrical Power Supply Cable
174. Outside Electrical Power Supply Cable Plug
175. Electrical Control Switches (For On/Off Electronic Control Valve 75)
176. Pneumatic Kill Switch (Deactivate Main Power Supply)
177. Automatic Jet Scan Switching
178. Main Water Pressure 165 Control Electronic Switching of Pressure control Valve 162
179. Pressure Gauge (Indicator) psi
180. Coupler Union (of Outlet Fitting Assembly 149)
181. Intake Piping (of Suction Side of Water Pump 148)
182. Manual Shut Off Valve (Return Piping of Suction Side of Water Pump 148)
183. Coupler Union (Return Piping of Suction of Pump 148)
184. Coupler Union (of Electronic Pressure Control Valve 162) Discharge Side, of The Water Pump 148
185. Discharge Side of Water Pump 148
186. Diverter Valve—2-way With Inlet Port
187. Top Membrane Seal Means Assembly (as shown in FIGS. 4, 5, 6, 7)
188. Aerated (Or Non Aerated) Waterjet Impact Impression to Underside of Top Membrane 123. (Massage Effects)
189. Heater Element and Assembly
190. Water Pressure Relief Valve
191. Cooling Fan Assembly
192. Radiator Cooling System, Outlet Piping Suction Side of Water Pump
193. Outlet Fitting Assembly (Cooling System)
194. Inlet Fitting Assembly (Cooling System)
195. Air Pressure Electronic Control Valve of Air Pump Means 85
196. Water Inlet Piping (Cooling System)
197. Outlet Coupling Union (Cooling System)
198. Inlet Union Coupler (Cooling System)
199. Foot end Air intake,. Air Outlet Threaded Bodied Fitting Assembly of FIG. 11
200. Aperture (Air Intake, Air Outlet Assembly 30)
201. Air Inlet, Air Outlet, Internal Opening (of Fitting Assembly 199)
202. Foot end Air Inlet, Air Outlet Vent Guard (of Assembly 199)
203. Seal Flange (of Interior Enclosure Intake Air Control and Interior Air Relief Valve Threaded Bodied Fitting
204. Foot end Control Knob (of Interior Enclosure Intake Air Control and Interior Air Relief Valve Assembly 30
205. Lock nut (of Interior Enclosure Intake Air Control and Interior Air Relief Valve Assembly
206. Threaded Bodied Fitting (of Interior Enclosure Intake Air Control and Interior Air Valve Assembly
207. Connected Piping of Air Valve Assembly 199
208. Head end Interior Enclosure Intake Air Control and Exterior Air Relief Valve Assembly
209. Head end Air Intake, Air Outlet Threaded Bodied Fitting Assembly FIG. 10
210. Air Inlet, Air Outlet Internal Opening of Fitting Assembly 209
211. Head end Inlet, Air Outlet Vent Guard (of Assembly 208)
212. Intake Connect Piping (of Valve Assemblies 208 and 209)
213. Aperture (of Air Inlet, Air Outlet Assembly)
214. Seal Flange (of Interior Enclosure Air intake and Relief Valve Threaded Bodied Fitting 225
215. Foot end Safety-Air Relief Valve (of Air Control Knob 204)
216. Head end Control Knob (of Interior Enclosure Intake Air Control Interior Air Relief Valve 208.
217. Head end Safety Air Relief Valve (of Air Control Knob 216)
218. Cooling System Water Pump
219. Inlet Fitting Assembly of Water Pressure Relief Valve 190
220. Header Piping (to Safety Water Pressure Relief Valve 190)
221. Water Pressure Relief Valve 190 (Union Couplers)
222. Aperture Foot end (FIG. 11) (Riser 22)
223. Aperture Head end (FIG. 10) (Riser 22)
224. Lock nut (of Interior Enclosure Intake Air Control and Interior Air Relief Valve Threaded Bodied Fitting)
225. Interior Enclosure Air Intake & Relief Valve Threaded Body Fitting
226. Head end Interior Enclosure End Side Wall Air Intake, Air Outlet Threaded Bodied Fitting (of Assembly 199)

Figure 11:
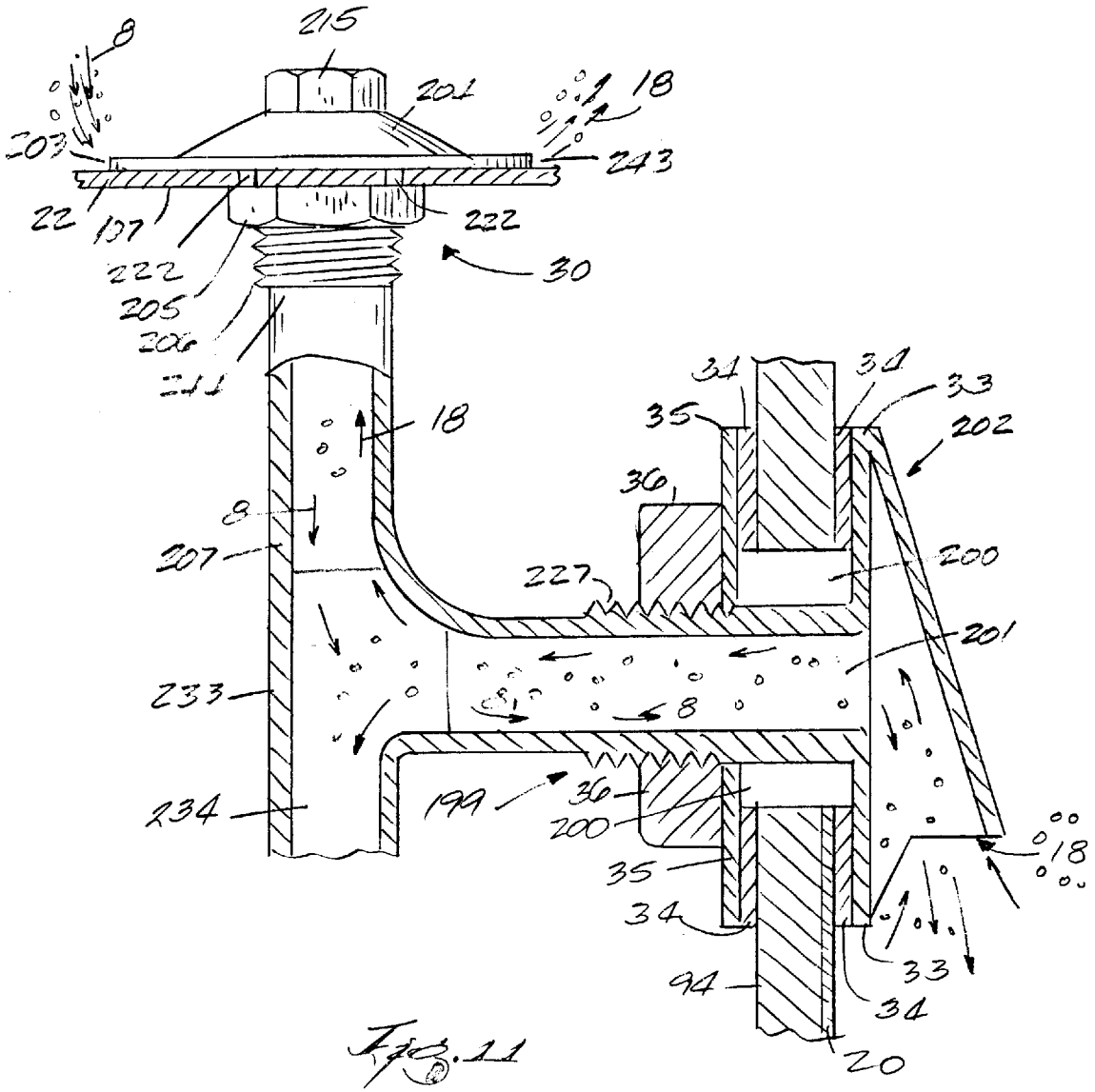

227. Foot end Interior Enclosure End Side Wall Air Intake, Air Outlet Threaded Bodied Fitting (of Assembly 199)
228. Gasket P.V.C. (of Top Membrane Seal Means 187, FIG. 7)
229. Retainer Strip 28 Cap. (of Top Membrane Seal Means 187, FIG. 7)
230. Hold Down Bolts (Retainer Strip Membrane Seal Means 187—FIG.7)
231. Three-way 90° Elbow Fitting (Head end)
232. Intake Piping (Suction Side of Air Pump Means 85)
233. Three-way 90° Elbow Fitting (Foot end)
234. Intake Piping (Suction Side of Air Pump Means 85)
235. Retainer Strip Holes (of Retainer Strip 28)
236. Interior Enclosure Air Intake Control and Air Relief Valve Intake Port (of Assembly 208)
237. See FIG. 10 Intake Port of Assembly 209
238. Ambient Air Intake Vent (of Air Pump Means 148)
239. Horizontal Air Intake Pipe Lead (Air Pump Means 148) Connected to Three Way 90° Elbow 234
240. Electronic Air Intake Control Valve (of Foot end Air Intake and Outlet Assemblies 199 and 30, As Seen in FIG. 11
241. Vertical Pipe Lead of Connected Air Intake and Outlet (not shown) Assemblies 199 and 30
242. Inlet Port of Enclosure Intake Air Control and Interior Air Relief Assembly 30
243. Inlet, Outlet Port of Assembly 30
244. Intake Connected Piping of Valve Assembly 30

While the subject invention has been herein shown and described in what is presently conceived to be the most practical and preferred embodiment, it will be obvious to one of ordinary skill in the art that many modifications may be made thereof within the scope of the invention, which scope is not to be limited except by the appended claims.

I claim:

1. A method of water massage comprising the steps of:

supporting a person in a reclining position on a top membrane of an enclosure containing a layer of water of sufficient standing depth to support the person in a floating manner;

drawing the water out of the enclosure;

introducing the water into the interior of the enclosure through a plurality of water/air inlet assemblies spaced apart and aimed upwardly at the underside of the top membrane, said water/air assemblies having a water inlet means and an air inlet means, said water/air inlet assemblies further having a venturi means through which the water flows, said air inlet means being in communication with said venturi means so that air will be drawn into the flowing water and become mixed therewith;

imparting sufficient pressure to the water drawn from the enclosure to drive the water/air mixture flowing out of said water/air inlet assemblies through a depth of water to impinge upon the underside of the top membrane on which the person is supported to produce massage effects on a plurality of areas of the person, such as shoulders, back and/or legs; and collecting the air in the enclosure in an air space within the enclosure and then recirculating the collected air back to the air inlet means of each water/air assembly.

2. The method of claim 1 further comprising the step of selectively controlling the flow of water to each water/air assembly to thereby apply massage effects to selected areas of the person.

3. The method of claim 1 further comprising the step of introducing air under pressure to the air inlet means of each water/air assembly by means of an air pump.

4. The method of claim 1 further comprising the step of introducing air under pressure to the air inlet means of each water/air assembly by means of an air pump and at the same time terminating the recirculation of collected air from the air space in the enclosure.

5. Water therapy apparatus comprising:

an enclosure having a top membrane of water impervious material for supporting a person in a reclining position;

a volume of water within said enclosure;

base means for supporting the enclosure in an elevated position;

a plurality of water/air assembly inlets and at least one water outlet sealingly mounted in the enclosure with said water/air assembly inlets spaced apart from each other and aimed upwardly toward the underside of the top membrane, said water/air assemblies having a water inlet means and an air inlet means, said water/air inlet assembly further including a venturi means through which water is pumped under pressure, said air inlet means being in communication with said venturi means so that air will be drawn into the water and become mixed therewith;

a water pump in fluid communication with said water outlet to draw water from the enclosure, said water pump in fluid communication with said water inlet means of said water/air assembly, said water pump imparting sufficient pressure to the streams of the pressurized water/air mixture to drive said streams through the water in the enclosure to impinge on the underside of the top membrane and thereby produce massage effects to the person; and an air space within the enclosure for collecting air, said air space in fluid communication with said air inlet means of said water/air assembly to produce circulation of air from the air space to said air inlet means.

6. Water therapy apparatus according to claim 5 including an air check valve in said air inlet means of said water/air assembly to prevent water backing up into air system.

7. Water therapy apparatus according to claim 5 including an air pump in fluid communication with said air inlet means of said water/air assembly to supply air under pressure to said water/air assembly and an air control means for terminating the flow of collected air from said air space in the enclosure when said air pump is energized.

8. Water therapy apparatus according to claim 5 including a water control means for selectively controlling the flow of water to each water/air assembly to thereby apply massage effects to selected areas of the person.

9. Water therapy apparatus according to claim 5 including an air pump in fluid communication with said air inlet means of said water/air assemblies to thereby introduce air under pressure into said water/air assemblies.

* * * * *